United States Patent [19]

Kelly

[11] 4,223,486

[45] Sep. 23, 1980

[54] ROOF EQUALIZER

[76] Inventor: Thomas L. Kelly, 50 Randolph Ave., Waterbury, Conn. 06710

[21] Appl. No.: 960,471

[22] Filed: Nov. 13, 1978

[51] Int. Cl.[2] ..... E04F 17/04

[52] U.S. Cl. ..... 52/1; 52/173 R; 52/199; 52/302

[58] Field of Search ..... 52/199, 302, 1, 173 R; 98/42 R, 118, 119

[56] References Cited

U.S. PATENT DOCUMENTS

| | | | |
|---|---|---|---|
| 2,192,458 | 3/1940 | Swenson et al. | 52/302 X |
| 2,833,229 | 5/1958 | Donegan | 52/302 |
| 3,817,009 | 6/1974 | Elder | 52/199 X |
| 3,984,947 | 10/1976 | Patry | 52/199 |
| 4,005,557 | 2/1977 | Kramer | 52/173 R |

FOREIGN PATENT DOCUMENTS

| | | | |
|---|---|---|---|
| 1169106 | 4/1964 | Fed. Rep. of Germany | 52/302 |
| 2060500 | 6/1972 | Fed. Rep. of Germany | 98/42 |
| 764973 | 1/1957 | United Kingdom | 52/302 |
| 1289758 | 9/1972 | United Kingdom | 52/179 |
| 1315334 | 5/1973 | United Kingdom | 98/42 R |

*Primary Examiner*—Alfred C. Perham

*Attorney, Agent, or Firm*—Peck & Peck

[57] ABSTRACT

A system of automatically transferring vacuum uplift on the top of a roof to the underneath side of the roof membrane to shift the uplift pressure forces into the roof insulation and decking rather than on the roof membrane to prevent upward movement of the membrane and roof layer. A roof structure provided with one or more oneway or duckbill valves placed 3 feet in from the perimeter and on every outside corner at 50 foot intervals, which at their bases open into the area between a loosely laid membrane and the roof insulation in order to equalize the positive air pressure between the loosely laid membrane and the insulation with the minus air pressure which occurs on the top of the roof when wind blows across the roof. Each equalizer ventilator consists of a vent in which is operatively placed a oneway valve which is opened under the influence of the minus pressure on top of the roof combined with the positive pressure which exists between the loosely laid membrane and the insulation to equalize these two pressures and prevent uplift of the loosely laid membrane. The plurality of oneway valves appear on a roof in different locations dependent upon the type of roof, as well as being dependent upon adjacent structures.

11 Claims, 5 Drawing Figures

ROOF EQUALIZER

SUMMARY OF THE INVENTION

In many roofing installations a body of insulation is provided upon which is loosely laid a membrane and upon this membrane a top roof layer is provided which may be of any suitable and desirable type. The loosely laid membrane is spot bonded to the body of insulation. It has been found that in roofing installations of this general character a minus air pressure occurs over the top of the roof and this minus air pressure may be caused by wind vortex produced by building shapes. Unless such minus air pressure which occurs on the top of the roof is somehow equalized, such pressure will cause the loosely laid membrane and the roofing layer to move upwardly from its desired operative position.

I have devised an ingenious system by which the minus and positive air pressures which occur between the underside of the loosely laid membrane and the top of the roof are equalized so that the membrane and the roofing layer will maintain their proper operative positions regardless of the wind caused minus air pressure which may occur on the roof. The equalization means between these two areas comprises a oneway valve. One end of this valve is open at all times to the positive pressure, which may occur between the loosely laid membrane and the insulation, and its other or outlet end is normally closed and is adjacent to and affected by the minus air pressure zone which results from wind movements across the roof. When the minus pressure occurs on the top of the roof and adjacent to the mouth or outlet end of the valve this normally closed mouth is opened by the positive pressure beneath so that the positive air pressure from the area between the insulation and the loosely laid membrane may flow up into and out of the mouth of the valve to thereby equalize the minus pressure on top of the roof and the positive pressure below the loosely laid membrane.

It has been my experience in this discipline that a number of oneway pressure equalizing valves may be utilized in a roof. For instance, the best results are obtained in a flat roof where there are no adjoining walls by locating a plurality of oneway valves in certain spacings and in certain locations on the roof. Again, it has been found that in a flat roof where there are adjoining walls of different heights the spacing and location of the valves on the roof will vary from that used in a flat roof with no adjoining walls. In the case of peaked roofs, the spacing and location of the oneway valves will be different from such spacing and location of the oneway valves in a flat roof.

It is to be recognized that it is within my contemplation to utilize this roofing structure in a variety of adaptations which do not include the spot bonding of the loosely laid membrane, as one example, instead of the spot bonding procedure, I may make use of a layer of gravel which is placed on top of the roofing sheet to hold it down.

Additional objects and advantages of the present invention will become more readily apparent to those skilled in the art when the following general statements and descriptions are read in the light of the appended drawings.

DETAILED DESCRIPTION

Figure 3:
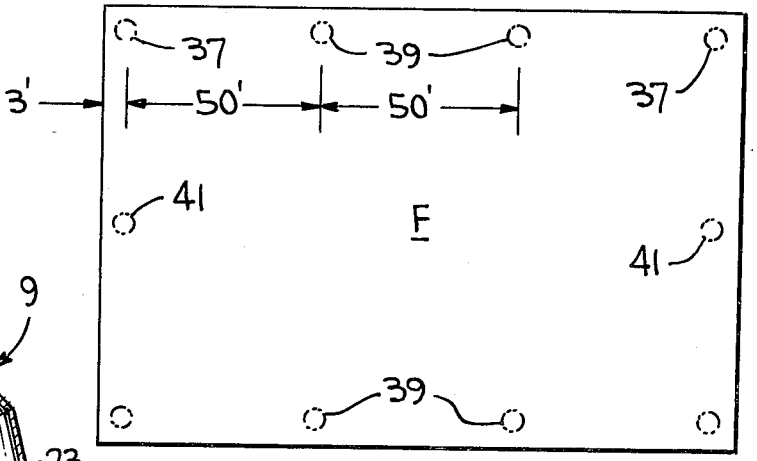
FIG. 3 is a plan view of a flat roof with the equalizer valves positioned thereon.

This invention relates generally to a system installed in a roof for equalizing minus pressures on the top of a roof with positive pressures within the roof. These differing pressures occur when the wind blows across a roof and are somewhat dependent upon the shape of the building which causes wind vortex, and the height of adjacent structures. In roofs of this general character a loosely laid membrane is positioned on the roof insulation and a gravel ballast may be disposed on the membrane or the membrane may be secured in position by a series of spot bonding pads. When these minus pressures occur on the top of the roof, they cause an undesired uplifting of the loosely laid membrane, and this invention provides, in a relatively simple and inexpensive manner, means for equalizing the minus and positive pressures so that the lifting of the loosely laid and spot bonded membrane will not occur when the aforedescribed pressure conditions exist.

A roof structure which is well adapted for this pressure equalization system comprises an I-beam 1 support or a roof joist 2, any suitable type of steel or wood deck 3 is supported on the I-beam or joist. A series of roof insulation blocks, designated generally by the numeral 5, are laid in any suitable manner on the deck 3 and each insulation block preferably has lapped joints designated by the numeral 7 at each end so that the blocks shown or any other suitable insulation means may be used.

A curved vent stack designated generally by the numeral 9 is provided and the outlet from this curved vent stack 9 is shown at 11 and is preferably provided with a screen 13. The outlet 9 from the curved vent stack is directed downwardly and is spaced from the roof membrane 15 and is disposed above a zone which becomes a minus or low pressure zone under certain wind conditions. The roof membrane 15 will be described in detail hereinafter. Consideration of the drawings clearly illustrates that the base of the vent stack 9 is of annular shape as at 17 and this base is fixed to the roof in any suitable manner. A metal base plate or inside collar 19 is provided with an upstanding annular collar 21 centrally fixed relative thereto. The body portion of the metal inside collar extends for a relatively short distance beneath the loosely laid membrane 15 and on top of the insulation blocks 5. It is to be understood that the metal inside collar extends radially outwardly a distance from the upstanding portion thereof. A oneway or duckbill type flexible valve designated generally by the numeral 23 is positioned in the vent stack 9. The oneway valve 23 assumes generally the curvature of the vent stack 9 when in operative position disposed therein and is provided with a normally closed mouth or exit end 25 which under the differential pressures to be described will open. The duckbill or oneway valve 23 adjacent to but downwardly disposed from the curved portion 26 thereof is provided with a tubular elongated portion 27 which terminates in what I shall term a vent rubber annular flaring portion 29 which is disposed over the membrane 15 and is secured thereto. The upstanding portion 21 of the metal inside collar 19 extends upwardly into the portion 27 and is secured to the circumferential wall thereof. It is to be distinctly understood that any suitable oneway valve may be used in this system and that the duckbill valve is disclosed herein merely by way of example and not by way of a limitation. It is also preferable that the duckbill valve 23 be formed of some flexible material. The insulation blocks 5 are preferably joined together at the lap joints thereof by screws or the like 31 which are screwed through the tongues of the lap joints and secure spot bonding pads 33 to the top of the insulation blocks. The insulation blocks 5 will not accept adhesive while the spot bonding pads 33 which are formed of masonite, plywood or other acceptable substitute that will accept adhesive so that as the membrane 15 extends along the roof it may be caused to adhere to the spot bonding pads 33 at a number of spaced spots along the roof. (See my patent application Ser. No. 792,784 filed May 2, 1977) now U.S. Pat. No. 4,162,597. It also should be noted that the insulation blocks 5 may be mechanically fastened to the steel or wood deck or they may be held in place by a gravel ballast which is installed on top of the rubber membrane 15. It should also be noted that changes may be made in the particular assembly of the vent rubber 29, the rubber membrane 15 and the metal inside collar 19 and that such changes will fall within the spirit and scope of this invention.

As pointed out above under certain wind conditions a minus pressure zone will occur above the membrane 15 so that a positive pressure zone will occur below the membrane 15 and above an insulation block 5 so that the membrane 15 will be lifted as shown at 35 and this positive pressure will flow between the metal inside collar 19 and up into the valve 23 and will cause opening of the outlet end 25 of the valve. When the mouth 25 of the valve is open it will permit the positive pressured air to flow into the minur pressure zone on top of the membrane. A very desirable feature of this pressure equalization system resides in the fact that when the minus pressure on top of the roof returns to normal the minus air pressure will remain under the roof membrane causing the roof membrane to be sucked down to the insulation.

The number and the relative positioning of a plurality of the equalizing means or valves are determined by a number of factors, such as the size and shape of the roof and the areas where these differential pressures are most likely to occur, as well as the type of roof and whether there are adjoining structures, such as walls. For instances, in a flat roof with no adjoining structures a certain spacing relationship between the valves is followed, while if there are adjoining structures to the flat roof which are higher than the roof, a different procedure is followed and in the case of peaked roofs a further orientation of the valves is followed. In the case of parapet walled roofs which are 2' or greater valves or equalizers are required, as close to the parapet as possible with flat roof spacing.

In FIG. 3 of the drawings I have shown a flat roof with the plurality of equalizers spaced apart and arranged to perform their functions in the best possible manner. In a flat roof F such as illustrated in FIG. 3 where there are no adjoining structures I provide a valve 37 at each corner of the roof and each valve 37 is positioned at approximately 3' from the perimeter of the roof. The remaining valves 39 are spaced apart a distance of substantially 50 linear feet, as well as being spaced from the corner valves 37 a distance of 50'. These valves 39 and 41 are also spaced from the perimeter of the flat roof F a distance of approximately 3'. It will be appreciated that in larger roofs more valves 39 and 41 may be used and the 50' spacing will still be followed as well as the placement of each valve approximately 3' from the perimeter of the roof.

Figure 4:
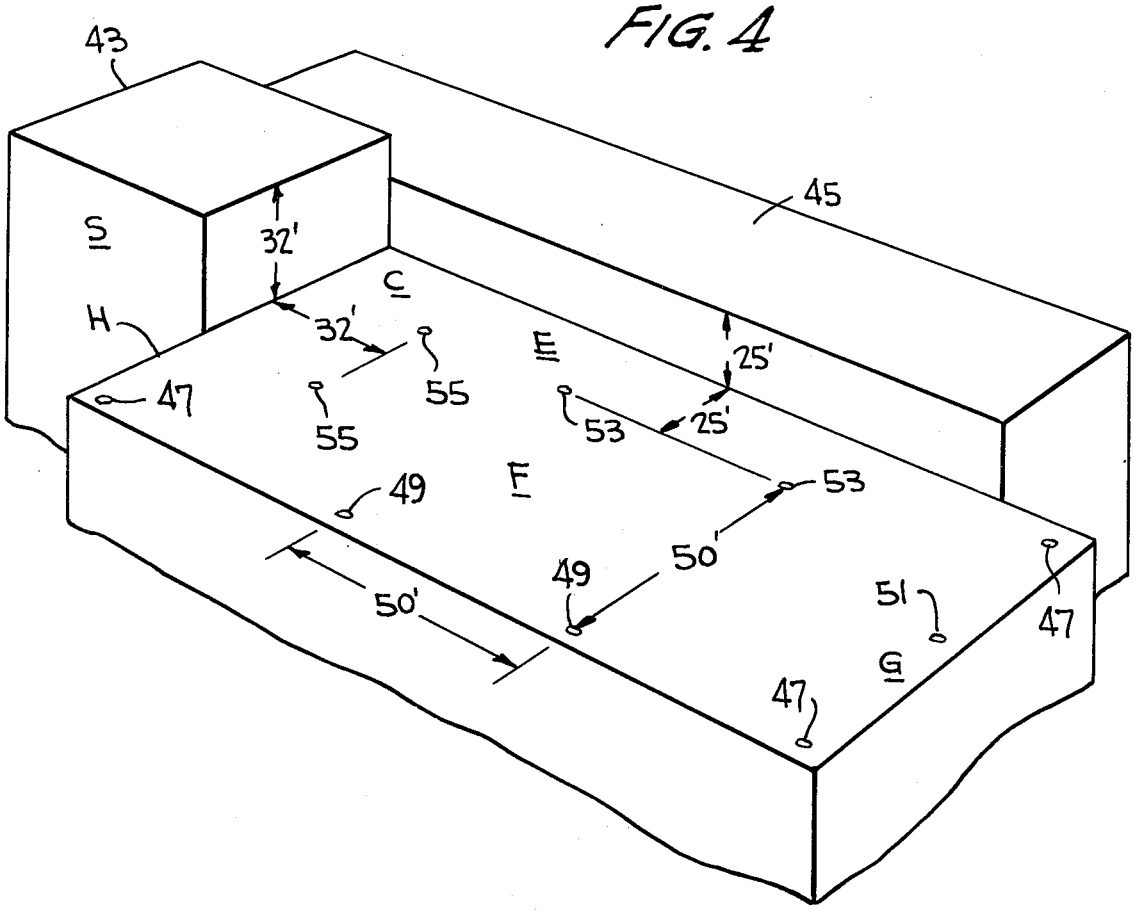
FIG. 4 is a perspective view of a flat roof where there are adjoining structures or walls which are higher or above the surface of the flat roof.

In FIG. 4 of the drawings a flat roof F is shown, however, this differs from the construction illustrated in FIG. 3 due to the fact that adjoining structures or walls 43 and 45 are adjacent the roof. Assuming that the adjoining wall or structure 43 is 32' higher than the top of the roof F and the structure 45 is 25' higher than the roof, the following arrangement of the valves will be followed. A valve 47 is provided at each corner of the roof with the exception of the corner marked C which is adjacent to the wall 43. Again, the valves 47 are positioned approximately 3' inwardly from the perimeter of the roof and the valves 49 are likewise positioned approximately 3' from the perimeter of the roof and are spaced approximately 50' from each other as well as from the corner valves 47. The valves 49 are placed on the roof along the edge of the roof which is remote from the edge E of the roof which is adjacent to the wall 45. One or more valves 51, depending on the size of the roof, are provided on the edge G of the roof which is remote from the edge H of the roof at which the wall 43 is adjoined. The valve 51 is spaced inwardly approximately 3' from the edge G of the roof and is approximately 50' from each of the two corner valves 57. The valves 55 are positioned on the roof approximately 32' from the edge H of the roof, it is noted that the wall 43 is 32' higher than the roof. The valves 55 are positioned approximately 50' apart, one of them being generally in alignment with the side S of the wall 43 and the other valve 55 being in the same horizontal plane as the wall or adjoining structure 43. Similar rules for the disposition of the valves 53 which are generally adjacent to the wall 45 are followed. As stated, the wall 45 is approximately 25' higher than the surface of the roof so the valves 53 are disposed 25' from the edge E of the roof and these valves 53 are spaced approximately 50' apart.

Figure 1:
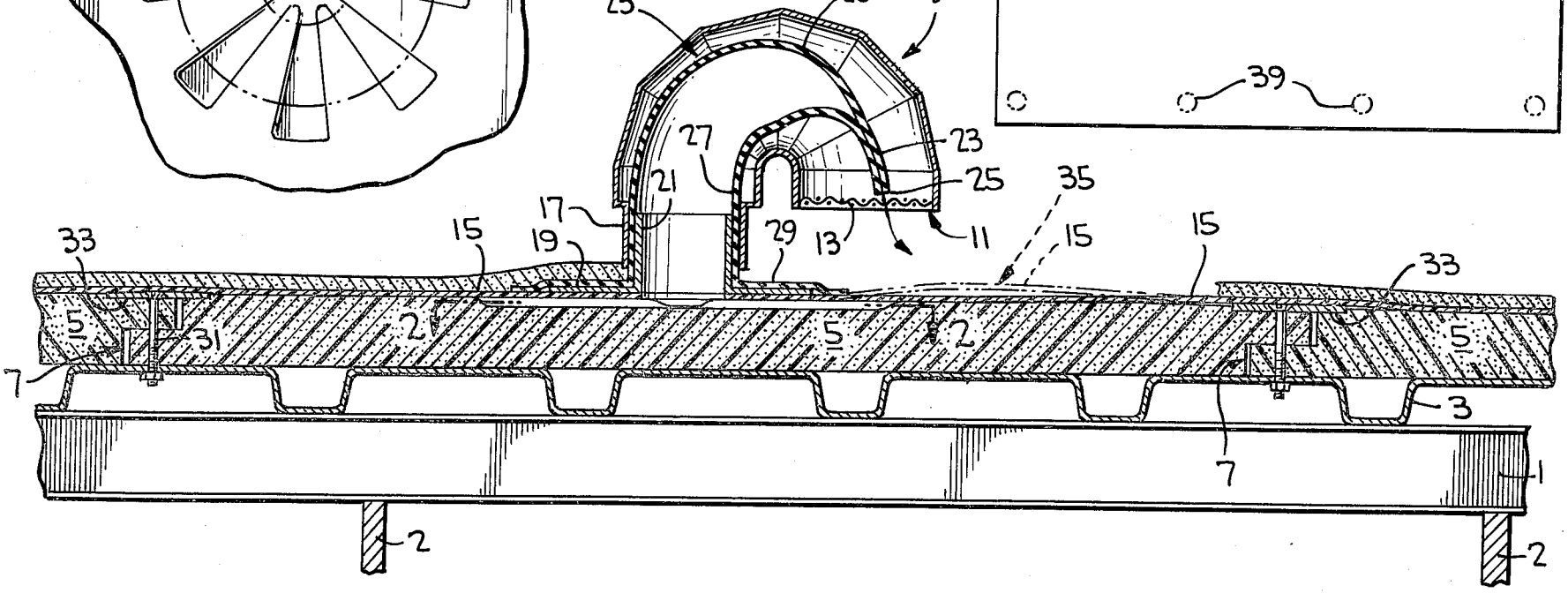
FIG. 1 is a sectional view through a roof construction illustrating in detail a roof equalizer.
Figure 2:
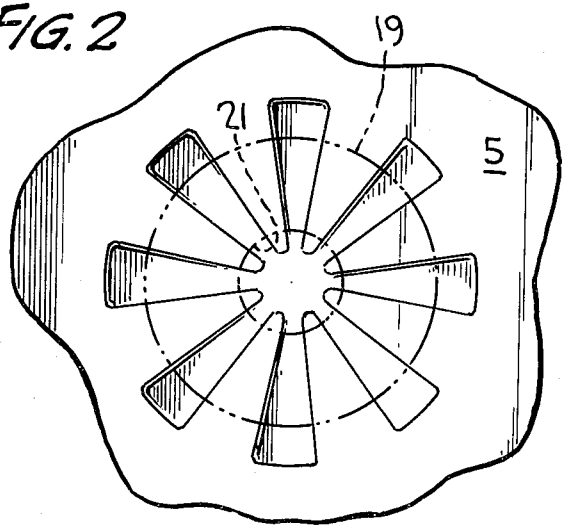
FIG. 2 is a sectional view taken on line 2—2 of FIG. 1.
Figure 5:
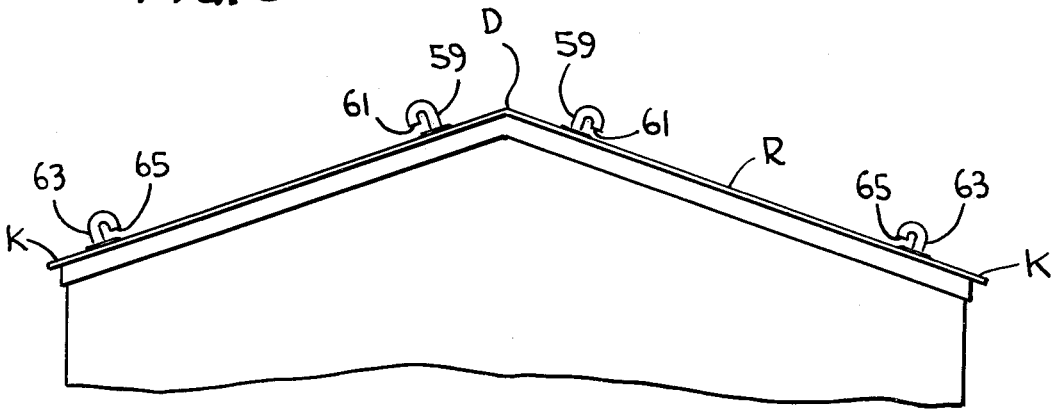
FIG. 5 is a sectional view of a peaked roof construction and illustrating the positioning of the valves or equalizers thereon.

In FIG. 5 a peaked roof is illustrated and this illustration shows such a roof where the peak is no greater than a 1' rise in 3'. The valves 59 are provided on each side of the peak D and are 16' from the peak and it is to be understood that the nozzles 61 (which is shown at 11 in FIG. 1) are facing out. A plurality of valves 63 are provided with the nozzle 65 facing inwardly and these valves 63 are spaced apart approximately 50 linear feet and are disposed substantially 3' inwardly from the edge K of the roof.

What is claimed is:

1. A pressure equalizing system adapted for use on a flat roof the sides of which are unobstructed by adjoining structures which extend above the upper surface of the flat roof, the roof including a plurality of insulation blocks and a loosely laid membrane over said insulation blocks and spot bonded thereto, a plurality of one-way valves spaced apart on said roof and in communication with an area between the under surface of said loosely laid membrane and the upper surface of said insulation blocks and operable to relieve positive air pressure occurring between said loosely laid membrane and said insulation blocks and exhausting said positive pressure on the top surface of the roof one of said one-way valves being provided at each corner of the roof and additional valves being provided adjacent to but spaced from the sides of said roof, said additional valves being spaced from each other and from the corner valves a distance of approximately 50'.

2. A pressure equalizing system in accordance with claim 1, wherein every valve is positioned from the side of the roof a distance of approximately 3'.

3. A system for use in a flat roof including means operable to equalize the air pressure between the upper surface of the flat roof and an area within the roof, said means including a unitary structure comprising a base and a valve, the base and the valve being in communication, the base being mounted within the flat roof and extending upwardly from the upper surface of said flat roof, the valve having an outlet end in communication with the base and the outlet end of the valve being in a projected plane above the upper surface of said flat roof and directed toward the upper surface of the roof, the flat roof including a loosely laid membrane and the portion of the base of said valve being disposed in and in communication with an area beneath said loosely laid membrane, the valve being automatically operable to equalize a minus air pressure in a zone on the upper surface of said flat roof adjacent to the outlet end of said valve with a positive pressure zone in an area beneath said loosely laid membrane, said area being in communication with said base.

4. A system in accordance with claim 3, wherein said flat roof includes a plurality of insulation blocks and a roof deck, said insulation blocks being mechanically fastened to said roof deck, and said loosely laid membrane being laid on the upper surface of said insulation blocks and spot bonded thereto, and said unitary structure extending in a projected plane above the upper surface of said roof and said insulation blocks.

5. A system in accordance with claim 3, wherein the unitary structure provides an upstanding and curved vent stack which is fixed to said base, said vent stack including a valve having an outlet end spaced above the upper surface of the roof and directed toward the roof, the outlet end of the valve being adjacent the outlet end of the vent stack for flow of positive pressure from within the roof for its exit toward the roof at the outlet end of the vent stack.

6. A system in accordance with claim 5, wherein said vent stack includes the base which is fixed to and extends into the roof and extends upwardly therefrom and said vent stack further includes a curved portion in communication with the base, the curved portion being directed toward the roof and including said valve which conforms to the general configuration of the vent stack.

7. A system in accordance with claim 4, wherein said unitary structure is in a projected plane upwardly from said loosely laid membrane and said insulation blocks.

8. A pressure equalizing system for use in a flat roof, the roof including a plurality of insulation blocks and a loosely laid membrane over said insulation blocks and spot bonded thereto, at least one side of said flat roof having an adjoining structure which extends above the top surface of the flat roof, a plurality of one-way valves spaced apart on said roof and in communication with an area between the under surface of said loosely laid membrane and the upper surface of said insulation blocks and operable to relieve air pressure occurring between said loosely laid membrane and said insulation blocks and exhausting said pressure on the top surface of the roof, a one-way valve being provided only at the corners of the roof which are free of the adjoining structure, additional one-way valves being provided adjacent to but inwardly spaced from the sides of the flat roof which are free of adjoining structures, said last named valves being spaced apart and spaced from the corner valves a distance of approximately 50', further one-way valves being provided adjacent to the sides of the flat roof which are adjacent the adjoining structure, the last named further one-way valves being spaced from the last named sides of the roof a distance approximately equal to the distance the adjoining structure rises above the top surface of the roof.

9. A pressure equalizing system in accordance with claim 8, wherein said valves at the corners of the roof and the valves which are provided adjacent the sides of the roof which are free of adjoining structures are positioned approximately 3' from the sides of the roof to which they are adjacent.

10. A pressure equalizing system adapted for use on a peaked roof, the roof including a plurality of insulation blocks and a loosely laid membrane over said insulation blocks, a plurality of one-way valves spaced apart on said roof and in communication with an area between the under surface of said loosely laid membrane and the upper surface of said insulation blocks and operable to relieve air pressure occurring between said loosely laid membrane and said insulation blocks and exhausting said pressure on the top surface of the roof, the peak of said roof being no greater than a 1' rise in 3', said one-way valves being positioned approximately 16' from each side of the peak, additional one-way valves being positioned on said roof approximately 50' from said last mentioned valves.

11. A pressure equalizing system in accordance with claim 10, wherein the outlet ends of said additional valves face inwardly and toward said peak.

* * * * *